US005188721A

United States Patent [19]

Pohto et al.

[11] Patent Number: 5,188,721

[45] Date of Patent: Feb. 23, 1993

[54] PLATE ANODE HAVING BIAS CUT EDGES

[75] Inventors: Gerald R. Pohto, Mentor; Lawrence J. Gestaut, Chagrin Falls, both of Ohio

[73] Assignee: Eltech Systems Corporation, Boca Raton, Fla.

[21] Appl. No.: 457,920

[22] Filed: Jan. 10, 1990

Related U.S. Application Data

[63] Continuation-in-part of Ser. No. 309,518, Feb. 10, 1989, abandoned.

[51] Int. Cl.[5] ..... C25D 17/12

[52] U.S. Cl. ..... 204/280; 204/290 R; 204/290 F; 204/272

[58] Field of Search ..... 204/280, 286, 290 R, 204/291, 272

[56] References Cited

U.S. PATENT DOCUMENTS

| | | | |
|---|---|---|---|
| 2,604,441 | 7/1952 | Cushing | 204/280 |
| 3,265,526 | 8/1966 | Beer | 117/50 |
| 3,632,498 | 2/1968 | Beer | 204/290 F |
| 3,711,385 | 6/1973 | Beer | 204/89 |
| 3,855,083 | 12/1974 | Hoeckelman | 204/28 |
| 4,119,515 | 10/1978 | Costakis | 204/211 |
| 4,469,565 | 9/1984 | Hampel | 204/15 |
| 4,528,084 | 7/1985 | Beer et al. | 204/290 F |
| 4,642,173 | 2/1987 | Koziol et al. | 204/290 F |

FOREIGN PATENT DOCUMENTS

| | | | |
|---|---|---|---|
| 0070284 | 4/1982 | Japan | 204/280 |
| 0080803 | 7/1934 | Sweden | 204/280 |

*Primary Examiner*—John Niebling
*Assistant Examiner*—Kathryn Gorgos
*Attorney, Agent, or Firm*—John J. Freer

[57] ABSTRACT

A fixed anode structure having at least one broad plate face utilized in electrodepositing a coating on a moving cathode has a segmented plate anode. The plate anode can have a broad face that is generally flat or curvilinear in relation to the shape of the cathode, e.g., in concentric relationship with a curvilinear cathode. The segmented anode has broad plate faces that come together to provide edges that are bias cut in relation to the path of travel of a cathode moving in relation to the anode.

13 Claims, 4 Drawing Sheets

PLATE ANODE HAVING BIAS CUT EDGES

CROSS-REFERENCE TO RELATED APPLICATION

This application is a continuation-in-part of U.S. patent application Ser. No. 309,518, filed Feb. 10, 1989, now abandoned.

BACKGROUND OF THE INVENTION

The use of non-sacrificial anodes for the continuous electrolytic coating of large objects, e.g., metal plating of steel coils, is well known. A representative electrolytic deposition process is electrogalvanizing. For such deposition, a substrate metal, such as steel in sheet form feeding from a coil, is run through an electrolytic coating process, often at high line speed. It has been known to design the anodes for such a process wherein characteristics such as electrolyte flow as well as other dynamics must be taken into consideration.

For example in U.S. Pat. No. 4,642,173 an electrode has been shown which has been designed by taking into consideration not only the high power requirements for an electrogalvanizing operation, but also considering control and direction of electrolyte flow pattern. In the structure of the patent, elongated lamellar anodes are positioned by bar-shaped current distributors onto sheet connectors attached to a current feed post.

It has also been known in electrolytic electrogalvanizing operation to utilize platelike anodes. In U.S. Pat. No. 4,469,565, a metal strip in non-horizontal orientation is shown opposite a platelike anode. Electrodeposition proceeds by means of electrolyte flow between the strip cathode and the plate anode.

Where anode plates are used, and especially where metal strips of varying width are to be plated, plating around the edge of a narrow strip may be a problem. Because of this, it has been proposed in U.S. Pat. No. 4,119,515 to use inner, hourglass shaped plates, with complementary outer U-shaped plates, for adjusting the anode to varying strip widths without the need for anode replacement.

There is still, however, the need for anode structures that can be utilized in deposition operation such as electrogalvanizing, which structures provide for economy of operation, uniformity of deposition without striping or plate build-up at anode junctions, coupled with ease and economy in replacement or repair, including anode recoating. There is also need for anode structures of reliable electrical contact providing uninterrupted power supply, which supply is achieved without disruption of plate anode surface uniformity. For example, where an anode is placed in an electrolyte useful for electrogalvanizing a steel coil and the coiled steel is moving rapidly in front of, and close to, the anode face, it is highly desirable to maintain best uniformity for anode to cathode spacing.

SUMMARY OF THE INVENTION

An improved, highly efficient and rugged anode structure has now been constructed. The structure provides for desirably reduced striping or deposition build-up in coatings deposited on moving cathodes. The anode structure can be served by reliable electrical contact, but without disrupting anode surface uniformity.

In a broad aspect, the invention is directed to an at least substantially planar shaped and inflexible anode structure containing fixed anode means having at least one face adapted for use in the electrodepositing of a coating on a moving cathode in sheet or strip form, which fixed anode means comprises a segmented plate anode having plate anode segments combining together to provide a broad, flat anode face for facing relationship with the moving sheet or strip cathode, the improvement comprising at least one anode segment having at least one bias cut edge, extending across the anode segment, which edge is bias cut in relation to the direction of travel of said cathode.

The plate anode can have a broad face that is generally flat or curvilinear, e.g., in concentric relationship with a curvilinear cathode.

DESCRIPTION OF THE PREFERRED EMBODIMENTS

The anode of the present invention can find particular utility in electrodeposition operation in an electrolytic cell wherein a deposit, e.g., a deposit of metal such as a zinc-containing deposit, is provided on a cathode. Exemplary of such operations is the electrogalvanizing of a substrate metal strip such as a steel strip. The anode can be particularly utilized in an electrodeposition operation wherein the cathode is a moving cathode, such as a moving sheet of steel as in an electrogalvanizing operation of coiled steel in strip form. For convenience, the anode may often be described herein in reference to use in an electrodeposition operation, and for illustrative purposes, such an operation may often be referred to as an electrogalvanizing operation. However, it is to be understood that the anode is contemplated for use in electrolytic cells utilizing other electrodeposition processes, e.g., the deposition of metals such as cadmium, nickel or tin, plus metal alloys as exemplified by nickel-zinc alloys, as well as in operations other than electrodeposition such as anodizing, electrophoresis and electropickling.

In reference to the drawings, the same identifying number has generally been used for the same element in each of the Figures. Referring to FIG. 1A, a prior art segmented plate anode is shown generally at 1. The anode as shown is made up of five plate anode segments 2. For purposes of simplicity of illustration, electrical supply means, anode support means and the like are not shown. In conjunction with a moving cathode, such cathode would be in movement across the faces of the anode segments in the direction represented in the Figure by the arrow A.

Figure 1:
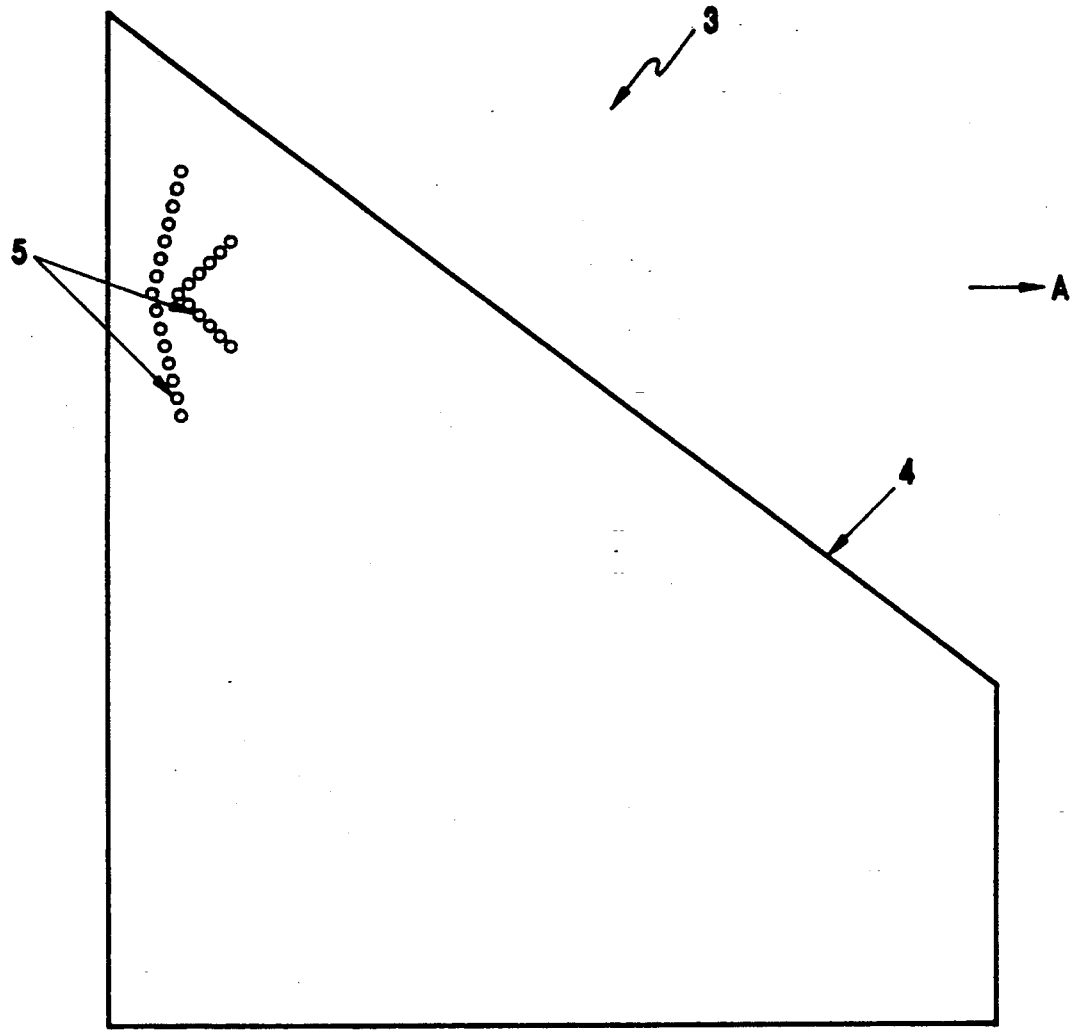
FIG. 1 is a front elevational view of a bias cut anode of the present invention.
Figure 1A:
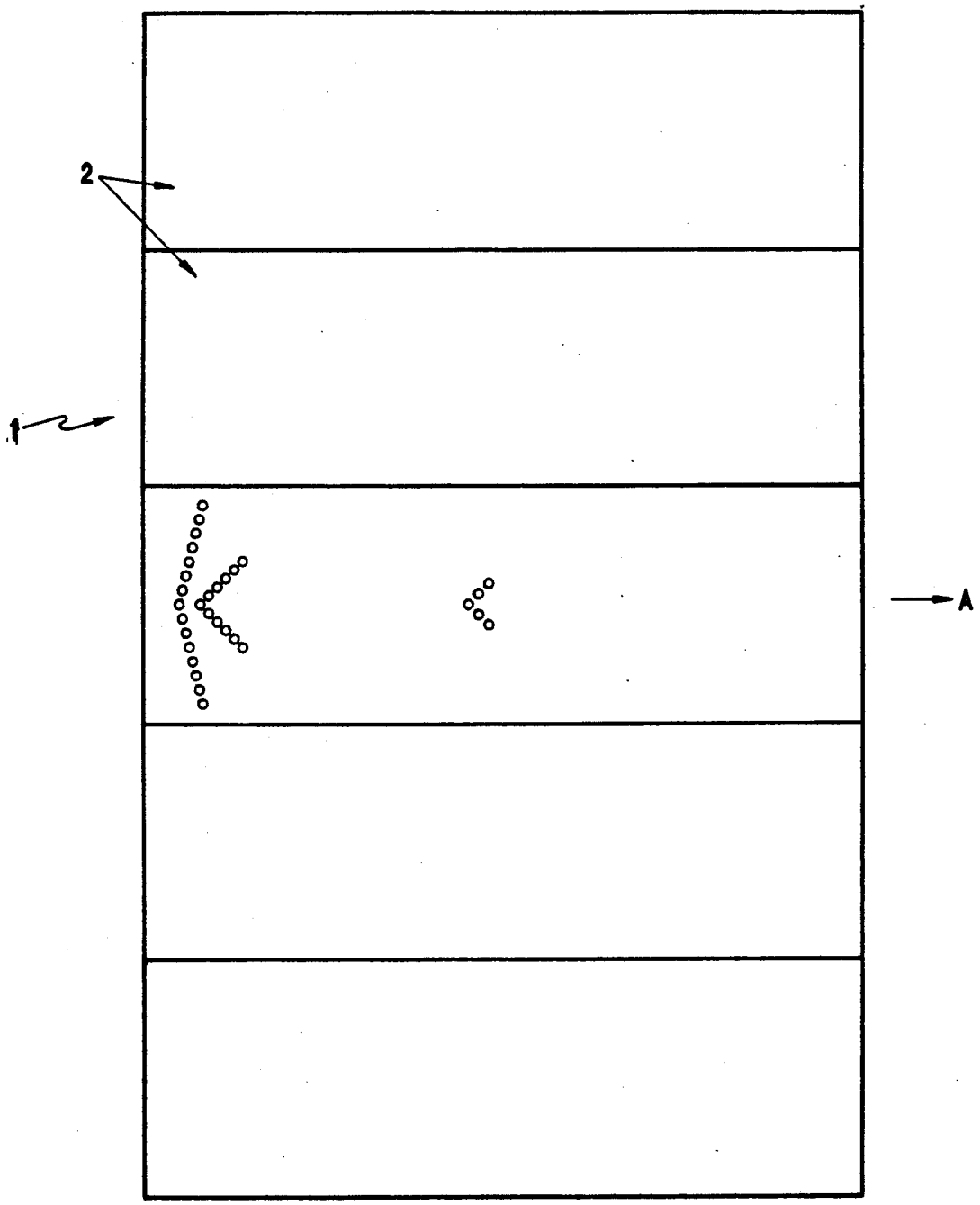
FIG. 1A PRIOR ART
FIG. 1A is a front elevational view of a segmented anode of the prior art.

Referring then to FIG. 1, there is shown a bias cut plate anode 3 of the present invention. This plate anode 3, which would otherwise be generally rectangular in shape, does, however, have a bias cut edge 4. Electrical current is supplied to the anode 3 by current distributors, which may connect through busswork to an electrical power supply, all not shown. A second plate anode, also not shown, will have a bias cut edge for positioning against the bias cut edge 4 of the plate anode 3. Thus, there will be a set of plates. The plate anode 3 is penetrated by electrolyte supply orifices 5 connected with electrolyte supply means, not shown. Furthermore, the plate anode 3 is held in place to a support structure, not shown. The bias cut edge 4 for the plate anode 3 is spaced apart from the electrolyte supply orifices 5.

Figure 2:
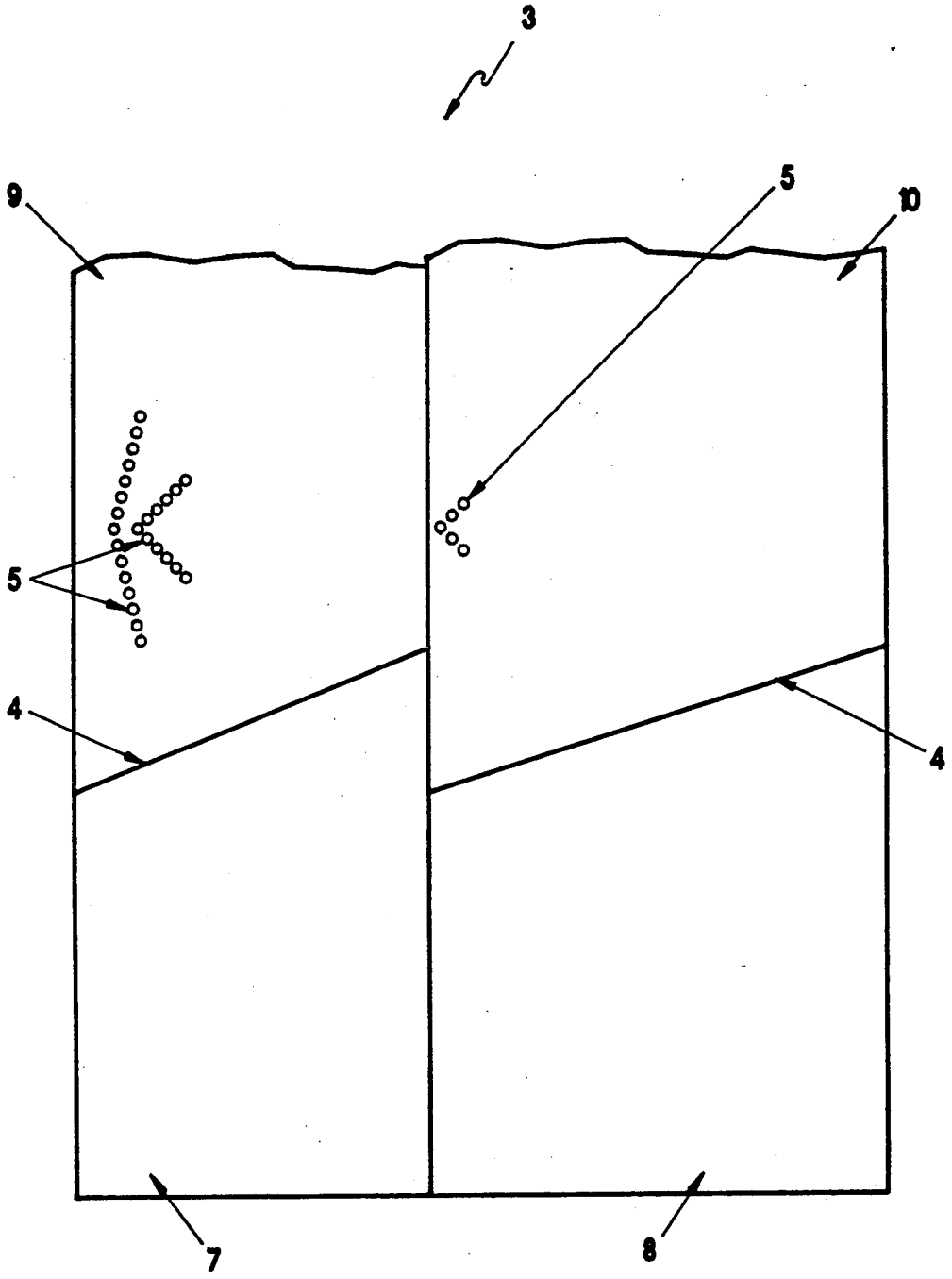
FIG. 2 is a front elevational view of a variant for a bias cut anode of the present invention.

It is to be understood that many variations for the positioning and the angle of cut are contemplated for the bias cut edge. In one broad anode plate, several bias cut edges may be present and some edges may intersect. Referring then to FIG. 2, there is shown one of these variations for a bias cut anode segment 2 of the present invention. This anode segment 2 which would otherwise be generally rectangular in shape, is comprised of four plates 7, 8, 9 and 10 each having a bias cut edge 4. Electrical current is supplied to the anode segment 2 in a manner as described hereinbefore. Two plate anodes 9, 10 are penetrated by electrolyte supply orifices 5. Furthermore, the plates 7, 8, 9 and 10 are all held in place to a support structure, not shown. The bias cut edges 4 for all plates 7, 8, 9 and 10 are spaced apart from the electrolyte supply orifices 5.

Figure 3:
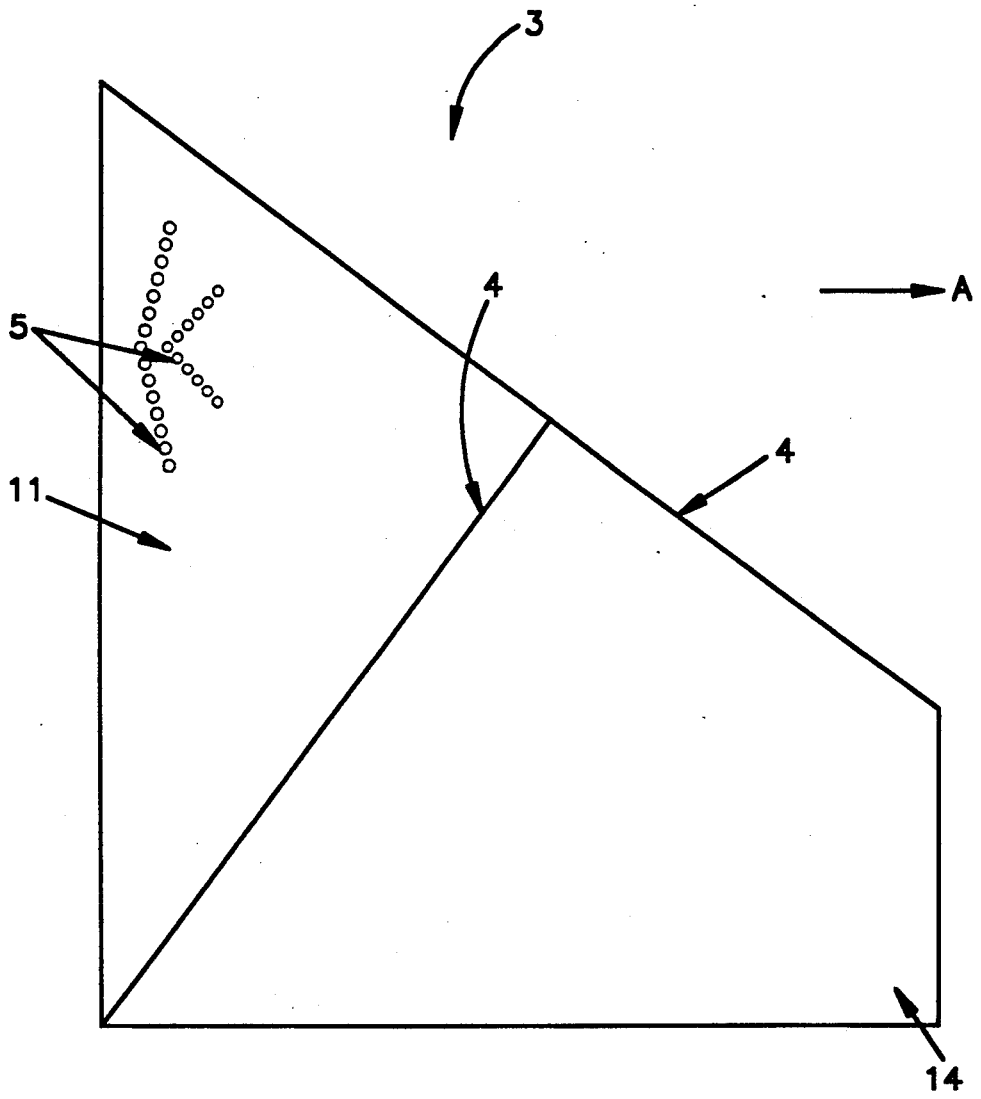
FIG. 3 is a front elevational view of a still further variant of a bias cut anode of the present invention.

Referring then to FIG. 3, there is shown yet another variation for a bias cut plate anode 3 of the present invention. This plate anode 3, which would otherwise be generally rectangular in shape, is comprised of two plates 11 and 14 each having two bias cut edges 4. The anode plate 11 is penetrated by electrolyte supply orifices 5. The anode plates 11 and 14 are held in place to a support structure, not shown. Additional anode plates, not shown, will have bias cut edges for positioning such additional segments against the upper bias cut edge 4 of the figure, thereby providing overall a generally rectangular..plate anode 3. Each bias cut edge 4 for the plates 11 and 14 is spaced apart from the electrolyte supply orifices 5.

In constructing the plate anode 3, only metal should be present at the edge of each bias cut edge 4. That is, these edges 4 are not insulated, one from the other, so that when the plate anode 3 is installed there is only metal facing metal at these edges. Usually, on manufacture and installation of the plate anode 3 as segments, there will be simply an air gap between each edge 4. In operation, such a gap will virtually always, to always, be filled with electrolyte. The electrolyte can serve to maintain electrical contact between plate segments at the gap. It is, however, contemplated that bus bars will typically be designed to supply current across the width of the plate anode 3, as is conventional for the industry.

As shown more particularly in the figures, each bias cut edge 4, is a straight line, continuous edge. Also, it is preferred for best coating efficiency, that each plate anode 3 segment contains at least one bias cut edge 4. Thus, plate segments at the outer edge opposite a metal strip, as well as the plate segments at the center, will preferably all bear at least one bias cut edge. These edges on anode installation are generally brought as close together as efficiently feasible. Typically, the width of the gap between adjacent segment edges will range from no more than 0.001 inch up to at most about 0.03 inch. Preferably, for most efficient plating, the gap distance between segments at the bias cut edge will be between 0.001 to 0.005 inch.

Also, as shown most particularly in the figures, it is contemplated that the bias cut edge will typically be at an acute angle to the path of travel of the metal strip. In the figures, these angles shown vary from about 40° to about 70°. Advantageously, these edges will be at an angle to the direction of the path of travel of the cathode of from about 30° to about 70°. Preferably, for most economical plate deposits such an angle will be from about 40° to about 60°. The plate anode segments may be positioned in a manner transverse to the path of travel of the moving cathode, as depicted by the center vertical line in FIG. 2, or may be positioned along the cathode travel path, in the manner as shown in FIG. 1A.

For the bias cut plate anode 3, it is contemplated that the materials of construction that will be used are non-consumable in the environment and include the refractory metals titanium, columbium, tantalum and the like, e.g., a titanium clad or plated metal such as titanium clad steel.

The active face of the plate anode 3 will advantageously for best anodic activity, contain an electrocatalytic coating. Such will be provided from platinum or other platinum group metal, or it may be any of a number of active oxide coatings such as the platinum group metal oxides, magnetite, ferrite, cobalt spinel, or mixed metal oxide coatings, which have been developed for use as anode coatings in the industrial electrochemical industry. The platinum group metal or mixed metal oxides for the coating are such as have generally been described in one or more of U.S. Pat. Nos. 3,265,526, 3,632,498, 3,711,385 and 4,528,084. More particularly, such platinum group metals include platinum, palladium, rhodium, iridium and ruthenium or alloys of themselves and with other metals. Mixed metal oxides include at least one of the oxides of these platinum group metals in combination with at least one oxide of a valve metal or another non-precious metal.

What is claimed is:

1. In an at least substantially broad faced and inflexible anode structure containing fixed anode means having at least one face adapted for use in the electrodepositing of a coating on a moving cathode in sheet or strip form, which fixed anode means comprises anode segments in plate form, each segment having width and length dimensions, said anode segments in plate form combining together to provide a broad anode face for facing relationship with said moving sheet or strip cathode, wherein the improvement comprises:

(a) anode plates for said anode segments, with a segment having (b) at least one first anode plate having at least one bias cut metal edge extending in a continuous line completely across the width dimension of said first anode plate, with, (c) an adjacent, second anode plate having a bias cut metal edge extending in a continuous line completely across the width dimension of said second anode plate, and opposite the bias cut edge of said first anode plate, with (d) each bias cut edge being bias cut in relation to the direction of travel of said cathode.

2. The anode structure of claim 1, wherein said bias cut edges extend in a straight line completely across the width dimension of said anode.

3. The anode structure of claim 1, wherein all anode plates have at least one bias cut edge.

4. The anode structure of claim 1, wherein the opposing bias cut edges of said anode segments are separated by a non-insulated gap of from about 0.001 inch to about 0.03 inch.

5. The anode structure of claim 4, wherein said gap during electrodeposition is at lest substantially filled with electrolyte.

6. The anode structure of claim 5, wherein adjacent anode plates are in electrically conductive contact across the gap.

7. The anode structure of claim 1, wherein said bias cut edge extends through said anode segments at an angle to the path of travel of said moving cathode of from about 30° to about 70 °.

8. The anode structure of claim 1, wherein said fixed anode means contains at least one electrolyte entry orifice penetrating through said broad anode face and said bias cut edges are spaced apart from said orifice.

9. The anode structure of claim 8, wherein electrolyte supply means connect with said electrolyte orifice for supplying electrolyte to said broad anode face.

10. The anode structure of claim 1, wherein said broad anode face is an active anode face containing an electrocatalytic coating.

11. The anode structure of claim 10, wherein said electrocatalytic coating contains a platinum group metal or contains at least one oxide selected from the group consisting of platinum group metal oxides, magnetite, ferrite and cobalt oxide spinel.

12. The anode structure of claim 10, wherein said electrocatalytic coating contains a mixed oxide material of at least one oxide of a valve metal and at least one oxide of a platinum group metal.

13. The anode structure of claim 1, wherein said plate anode segments are curved and said curved segments are spaced apart, in concentric relationship with a curvilinear cathode.

* * * * *